US009709316B2

(12) United States Patent
Miersen et al.

(10) Patent No.: US 9,709,316 B2
(45) Date of Patent: Jul. 18, 2017

(54) SPRING LOADED MULLION FOR FRENCH DOOR REFRIGERATOR

(71) Applicants: Roger C. Miersen, Marion, IA (US); Thomas E. Gose, Cedar Rapids, IA (US); James H. Jenkins, South Amana, IA (US)

(72) Inventors: Roger C. Miersen, Marion, IA (US); Thomas E. Gose, Cedar Rapids, IA (US); James H. Jenkins, South Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 632 days.

(21) Appl. No.: 13/761,350

(22) Filed: Feb. 7, 2013

(65) Prior Publication Data

US 2014/0217877 A1 Aug. 7, 2014

(51) Int. Cl.
*F25D 23/02* (2006.01)
*F25D 23/08* (2006.01)

(52) U.S. Cl.
CPC ..... *F25D 23/028* (2013.01); *F25D 23/02* (2013.01); *F25D 23/087* (2013.01); *F25D 2323/021* (2013.01)

(58) Field of Classification Search
CPC ..... F25D 23/028; F25D 23/02; F25D 23/087; F25D 2323/021
USPC ..... 312/405; 49/483.1
See application file for complete search history.

(56) References Cited

U.S. PATENT DOCUMENTS

| | | | | |
|---|---|---|---|---|
| 1,918,865 | A * | 7/1933 | Purdy | 49/313 |
| 1,948,017 | A * | 2/1934 | Wuebling | 49/416 |
| 2,723,896 | A | 11/1955 | Wurtz | |
| 2,767,040 | A | 10/1956 | Kesling | |
| 2,825,940 | A * | 3/1958 | Kurtz | 49/366 |
| 2,933,784 | A * | 4/1960 | Hooverson | 49/480.1 |
| 3,070,852 | A * | 1/1963 | Hilliker | 49/366 |
| 3,362,108 | A * | 1/1968 | Jones | 49/478.1 |
| 3,382,618 | A | 5/1968 | Townsend | |
| 3,466,804 | A | 9/1969 | Swaneck, Jr. | |
| 4,226,489 | A | 10/1980 | Haag | |
| 4,288,135 | A | 9/1981 | Buchser et al. | |
| 4,711,098 | A | 12/1987 | Kuwabara et al. | |
| 5,349,782 | A | 9/1994 | Yulkowski | |
| 5,411,328 | A | 5/1995 | You | |
| 5,542,258 | A | 8/1996 | Shim | |

(Continued)

*Primary Examiner* — Daniel J Troy
*Assistant Examiner* — Ryan A Doyle
(74) *Attorney, Agent, or Firm* — Diederiks & Whitelaw, PLC

(57) ABSTRACT

A refrigerator having French-style doors is sealed between the doors by a first sealing pad linearly biased from a base fixed within a recess provided in an inner side portion of one door, and a second sealing pad carried by a mounting arm which is pivotally mounted and angularly biased from an inner side portion of the second door. When either door is closed against the other, the first and second sealing pads deflect and conform to each other to provide an effective seal. In one preferred embodiment of the invention, the first and second sealing pads take complementary concave and convex shapes which provide a larger cross-section for the overall sealing area and establish a high insulation value, while avoiding the need for an internal heater commonly employed in refrigerator doors.

23 Claims, 4 Drawing Sheets

(56) References Cited

U.S. PATENT DOCUMENTS

| | | | | |
|---|---|---|---|---|
| 5,581,946 | A * | 12/1996 | Lin | 49/368 |
| 5,694,789 | A | 12/1997 | Do | |
| 5,816,080 | A | 10/1998 | Jeziorowski | |
| 5,975,661 | A * | 11/1999 | Jeziorowski et al. | 312/296 |
| 5,975,664 | A * | 11/1999 | Banicevic et al. | 312/405 |
| 7,008,032 | B2 | 3/2006 | Chekal et al. | |
| 7,178,293 | B2 * | 2/2007 | Kim | 49/478.1 |
| 7,823,331 | B2 | 11/2010 | Linkmeyer et al. | |
| 2005/0046319 | A1 * | 3/2005 | Chekal et al. | 312/401 |
| 2007/0125002 | A1 * | 6/2007 | Linkmeyer et al. | 49/368 |
| 2008/0209812 | A1 | 9/2008 | Lancry | |
| 2012/0262047 | A1 * | 10/2012 | Stocker | 312/405 |

* cited by examiner

SPRING LOADED MULLION FOR FRENCH DOOR REFRIGERATOR

BACKGROUND OF THE INVENTION

Field of the Invention

The present invention pertains to the art of refrigerators and, more particularly, to a refrigerator including first and second French-style doors employing a spring loaded mullion bar sealing arrangement which provides for an effective seal between the doors when closed, yet enables independent operation of each of the French-style doors.

Discussion of the Related Art

With the growing popularity of bottom mount refrigerators, certain manufacturers have found it desirable to provide French-style doors for the upper fresh food compartment. Such French-style door arrangements can be desirable for a number of reasons, including weight reduction of any given door. By design, French-style doors typically divide an opening in half such that each French door is approximately half the weight of a conventional door. In addition, with the increased number of storage zones being employed on refrigerator doors, the use of French-style doors enhances the arrangement for storing, as well as the accessibility to a wide variety of objects. Accordingly, when used in conjunction with a fresh food compartment, the size and strength of support structure, generally required in side-by-side applications, can be reduced substantially. However, despite all of the desirable features, there exists a drawback with French-style doors in that a mullion bar, which in side-by-side configurations divides the fresh food and freezer compartments, hinders taking goods in and out of the fresh food compartment. While the mullion is not required to "divide" the compartments, French-style doors require a central sealing surface.

A stationary mullion bar fixed to the refrigerator would limit the size and shape of goods capable of being placed in the compartment, as well as the accessibility to the goods. Toward that end, manufactures have basically devised three solutions to confront this issue. One solution is to mount a stationary mullion on one of the two French-style doors. With this arrangement, the door with the mullion is closed first, then the second door is closed against the mullion. While effective, this design necessitates a specific order of opening and closing the French-style doors and, if not followed, could lead to the door with the mullion bar being left ajar which would allow the cool air within the compartment to leak out.

The second solution offered by refrigerator manufacturers utilizes a rotating or pivoting mullion that alleviates the problems associated with the stationary mullion discussed above. Like the stationary mullion, the rotating mullion is carried by one of the two French-style doors. Typically, the mullion is caused to pivot when the door is opened or closed, with the mullion pivoting about hinge elements that allow the mullion to travel between first and second positions. U.S. Pat. No. 7,008,032 sets forth an exemplary form of such an arrangement.

The third solution avoids the use of a mullion completely. Instead, magnetic seals are provided along the adjacent central edge portions of the French-style doors, with the seals attracting to close off the fresh food compartment when the doors are closed. With this construction, the force required to open the doors is increased based on the need to overcome the magnetic attraction force. In addition, due to the attraction of the magnetic seals and the lack of any mullion structure to seal against, the seals tend to be pulled and distorted in various ways when opening and closing the doors which, over time, can lead to fatigue problems and improper sealing.

Based on the above, there still exists a need in the art for a French-style door refrigerator providing for enhanced sealing between the doors through the use of mullion structure carried by at least one of the doors.

SUMMARY OF THE INVENTION

The present invention is directed to a refrigerator having French-style doors and a mullion for sealing between the doors. In general, the refrigerator includes a cabinet shell having first and second refrigerated compartments each having a respective opening, with the French-style doors being provided to selectively seal the opening of the first refrigerated compartment. To this end, each of the French-style doors is provided with gasket structure extending along three sides, i.e., top, outermost and bottom sides, of the door to maintain a seal between the doors and the cabinet shell. On the remaining inner side, the two doors are adapted to seal together through the use of shiftable mullion structure.

More particularly, the French-style doors constitute first and second pivotally mounted doors. In accordance with the invention, a mullion is incorporated into an inner side portion of a first one of the doors. More specifically, the mullion includes a first mullion member or base which is mounted in a recess provided in the inner side portion of the door and a second mullion member which establishes a first sealing pad and is mounted to the base in a spring loaded fashion. The first mullion member is fixed to the door and the second mullion member is attached to the first mullion member for limited, relative linear movement, while being biased away from the base by a plurality of spring elements interposed between the first and second mullion members.

In addition, the other of the French-style doors is provided with a second sealing pad which, in combination with the mullion, is adapted to create a seal between the doors. In accordance with a preferred form of the invention, the second sealing pad is mounted to and extends from an inner side portion of the second door and is biased in a direction away from the inner side portion. More specifically, the second sealing pad is carried by a mounting arm which is pivotally attached to the second door. A biasing arrangement, such as one or more torsion springs, acts on the mounting arm in order to establish a biasing force tending to shift the second sealing pad away from the inner side portion of the second door.

With the above construction, when the doors are closed, the second mullion member is biased toward the inner side portion of the second door. More particularly, both the first and second sealing pads are biased into engagement with each other. In further accordance with the invention, the first and second sealing pads are preferably complementary in shape such that, when the doors are closed, the sealing pads conform to each other during engagement and provide an effective seal. In one preferred embodiment of the invention, the first and second sealing pads take complementary concave and convex shapes which provide a larger cross-section for the overall sealing area and establish a high insulation value. In fact, based on the enhanced sealing and high insulation value, the spring loaded mullion arrangement of the invention advantageously eliminates the need for an internal heater commonly employed in refrigerator doors.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
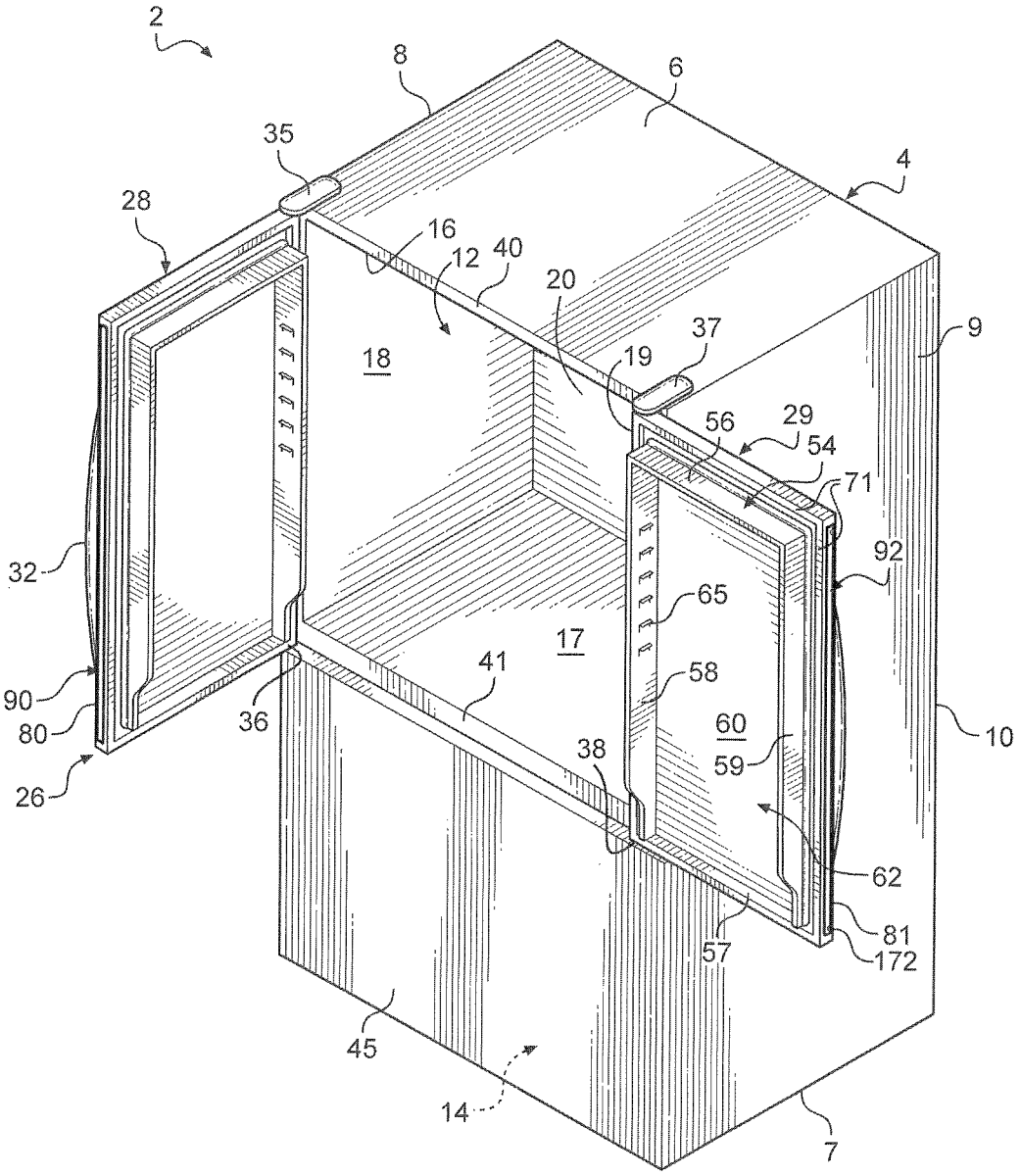
FIG. 1 is an upper right perspective view of a bottom mount refrigerator having French-style doors and a spring loaded mullion constructed in accordance with the present invention.

With initial reference to FIG. 1, a bottom-mount refrigerator constructed in accordance with the present invention is generally indicated at 2. Refrigerator 2 is shown to include a cabinet 4 having a top wall 6, bottom wall 7, opposing side walls 8 and 9 and a rear wall 10 which combine to form first and second compartments 12 and 14. In the embodiment shown, first or fresh food compartment 12 includes a liner having a top portion 16, a bottom portion 17, opposing side wall portions 18 and 19 and a rear wall portion 20. Although not shown, refrigerator 2 includes a refrigeration system establishing above and below freezing temperatures in compartments 12 and 14 respectively. In addition, although shown as an open space in this figure, fresh food compartment 12 would be provided with various shelves and bins for storing a wide range of food products in a manner known in the art.

Refrigerator 2 is provided with an upper door assembly 26 which, in accordance with the invention, is constituted by French-style doors including first and second doors 28 and 29. First and second doors 28 and 29 are provided with respective handles (one of which is shown at 32 for door 28) to enable a consumer to operate doors 28 and 29 in providing access to fresh food compartment 12. Actually, first and second doors 28 and 29 pivot about upper and lower hinges 35 and 36, 37 and 38 respectively. As detailed more fully below, first and second doors 28 and 29 are adapted to selectively seal against upper front face portion 40 and lower front face portion 41 of cabinet 4 to prevent cold air from escaping first or fresh food compartment 12. Actually, first and second doors 28 and 29 also seal against side portions of cabinet 4 (not separately labeled). Finally, a lower or freezer door 45 is provided to enable access to the second or freezer compartment 14. In the embodiment shown, refrigerator 2 is a bottom mount configuration with lower freezer door 45 being adapted to slide in and out of cabinet 4 to provide access to frozen goods located within second compartment 14.

Except as identified below, the structure of each door 28, 29 is substantially identical. Therefore, a detailed description of the basic structure of door 29 will be made and it is to be understood that door 28 has commensurate structure. As shown, a liner 54 is depicted as having an outwardly projecting top portion 56, bottom portion 57, opposing side portions 58 and 59 and a rear portion 60 which collectively define a storage cavity 62. In a manner known in the art, storage cavity 62 is provided with a plurality of shelf support elements, one of which is indicated at 65 on side portion 58. However, it should be understood that a corresponding plurality of shelf support elements (not shown) are provided on opposing side portion 59. In any event, shelf support elements 65 are adapted to receive a variety of shelf members, i.e. adjustable shelves, bins, storage units and the like, for retaining goods such as butter, soda and the like on door 29. Liner 43 is also provided with a flexible gasket 71 which extends along three door sides and is used in providing an air-tight seal for fresh food compartment 12 when door 29 is closed. Again, the liner for door 28 is identically constructed to that described above.

In general, the above-described structure of refrigerator 2 is known in the art and merely provided for the sake of completeness. As evident from the above, it should be readily apparent that doors 28 and 29 seal on three sides to in-turned face portions, including face portions 40 and 41, of cabinet 4 through gaskets 71, which can take various forms, preferably elastomeric seals with or without internal magnetic elements. In any case, the present invention is particularly directed to the manner in which doors 28 and 29 are sealed to each other along a central region, defined at inner side portions 80 and 81 of doors 28 and 29, in order to establish an air tight seal about fresh food compartment 12 when doors 28 and 29 are closed. That is, it is the sealing in the mullion area between the doors which is of concern to the invention. In connection with the sealing of this region, each door 28, 29 is provided with distinctive structure in the form of a first seal subassembly 90 carried by door 28 and a second seal subassembly 92 carried by door 29, with first and second seal assemblies 90 and 92 interengaging to establish an overall mullion seal assembly as will be detailed fully below.

Figure 2:
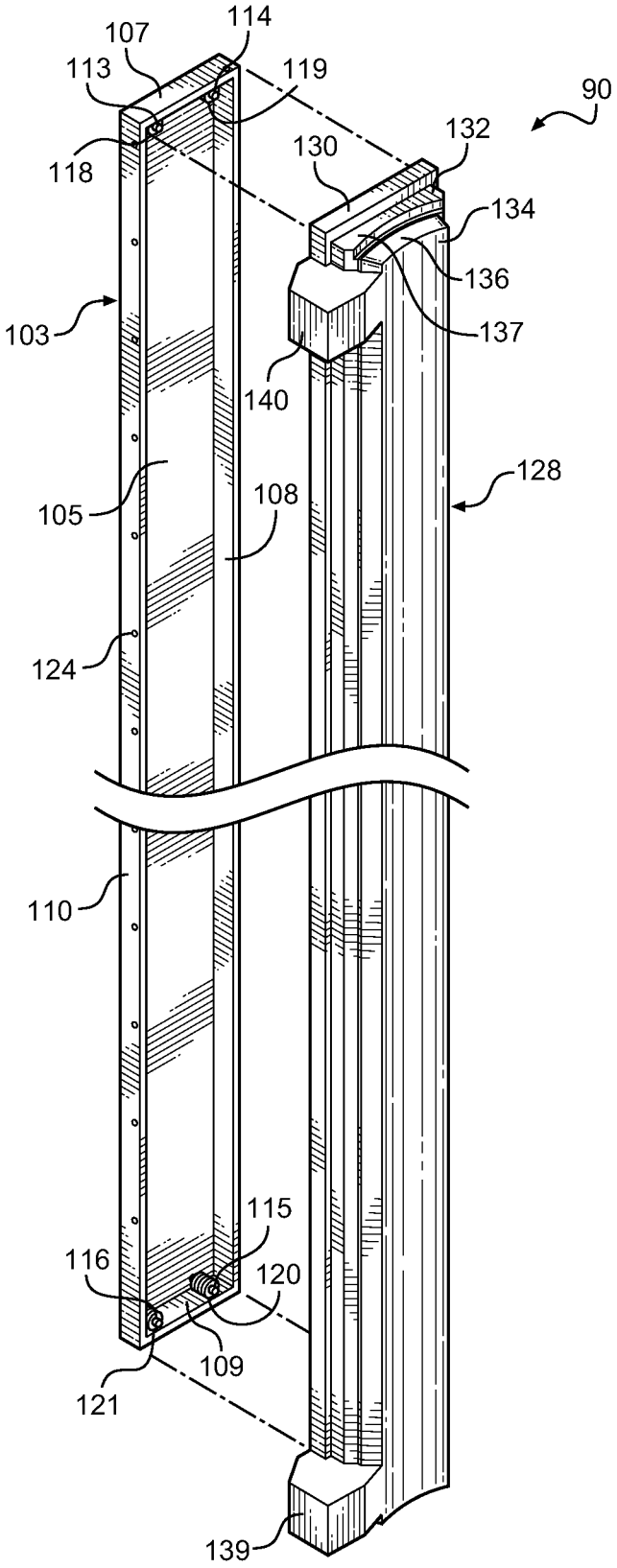
FIG. 2 is an exploded view of the spring loaded mullion of the refrigerator of FIG. 1.

With reference to FIG. 2, first seal subassembly 90 is shown in a partially exploded view. As depicted, first seal subassembly 90 includes a first mullion member or base 103 defined by a base panel 105 from which project a plurality of side wall portions 107-110. Also projecting from base panel 105, at positions spaced from side wall portions 107-110, are a plurality of guide elements 113-116. In the embodiment shown, guide elements 113-116 take the form of pins located adjacent the intersections of respective ones of side wall portions 107-110. Certainly, the number, location and structure of guide elements 113-116 can be varied in accordance with the invention so long as the intended function is performed as will be become more fully evident below. Associated with guide elements 113-116 are spring elements 118-121 respectively. As shown, spring elements 118-121 preferably take the form of compression springs, although other known types of biasing elements could be employed. Also provided on first mullion member 103 is a plurality of catch elements indicated at 124. More specifically, catch elements 124 project at spaced locations about side wall portions 107-110. As illustrated in FIG. 2, catch elements 124 generally constitute projections in the form of semi-hemispherical nubs. However, it should be understood that catch elements 124 can take various forms, including a wide range of polygonal shapes, including elongated ridges.

First seal subassembly 90 also includes a second mullion member 128 defined by a first body portion 130, a second body portion 132 and a third body portion 134 which defines a first sealing pad of first seal subassembly 90. First, second and third body portions 130, 132 and 134 are shown constructed in stepped fashion so as to establish a pair of perimeter ledges 136 and 137. Projecting from upper and lower portions of second mullion member 128 are a pair of spaced sealing blocks 139 and 140. At this point, it should be recognized that first seal subassembly 90 is shown in FIG. 2 to be inverted or rotated through 180° relative to FIG. 1, thereby better illustrating sealing blocks 139 and 140.

Figure 3A:
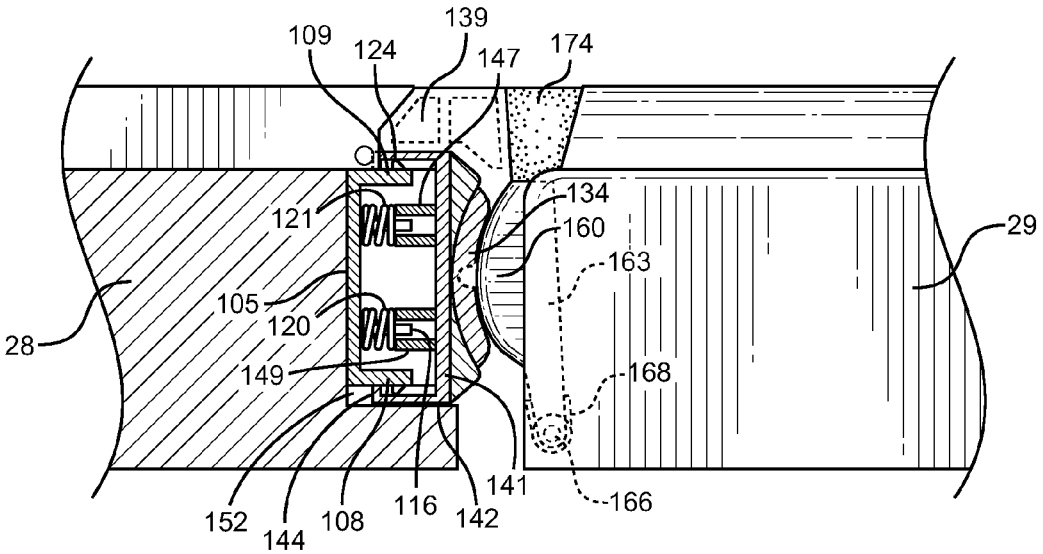
FIG. 3A is a partial cross-sectional view of the French-style doors of FIG. 1 in a closed, fully sealed position.

As better shown in FIG. 3A, first body portion 130 of second mullion member 128 includes a main body portion 141 from which laterally extend various side wall portions, one of which is labeled 142. Each side wall portion 142 terminated in an inturned end portion 144. In addition, projecting from main body portion 141 at positions spaced from side wall portions 142 are a plurality of sleeves 147, each of which terminates in an abutment surface 149.

First seal subassembly 90 is adapted to be mounted on one of doors 28 and 29. In the embodiment illustrated in FIG. 1, first seal subassembly 90 is actually mounted at inner side portion 80 of door 28. In particular, inner side portion 80 is provided with an elongated recess 152 within which first mullion member 103 is fixedly secured as depicted in FIGS. 1 and 3A. Spring elements 118-121 are provided about guide elements 113-116 and second mullion member 128 is mounted to first mullion member 103. During this mounting, each guide element 113-116 is aligned with and slidably received in a respective sleeve 147 and each spring element 118-121 engages a respective abutment surface 149. Upon pushing second mullion member 128 upon first mullion member 103, side wall portions 142 deflect outward such that inturned end portions 144 extend about catch elements 124, with inturned end portions 144 then becoming positioned behind catch elements 124. Therefore, first mullion member 103 is positioned in elongated recess 152 and fixed to door 28, while second mullion member 128 is mounted to first mullion member 103 in a spring loaded fashion. With this construction, second mullion member 128 is attached to first mullion member 103 for relative linear movement which is limited by the engagement of inturned end portions 144 with catch elements 124. In addition, second mullion member 128 is biased away from base panel 105 of first mullion member 103 by spring elements 118-121.

As indicated above, the overall mullion seal assembly also includes second seal subassembly 92 which is shown carried by door 29. In accordance with a preferred form of the invention, second seal subassembly 92 includes a second sealing pad 160 (see FIGS. 3A-3C) which is fixed to a mounting arm 163 that is recessed within inner side portion 81 of door 29. More specifically, mounting arm 163 is pivotally connected to door 29 through a pivot shaft 166 which defines a substantially vertical pivot axis. Acting between door 29 and mounting arm 163 is a biasing arrangement which acts to force second sealing pad 160 away from inner side portion 81. Although this biasing arrangement can take various forms, in accordance with the most preferred form of the invention, vertically spaced torsion springs, such as indicated at 168. As depicted, also extending from second sealing pad 160 is an alignment extension 172 (best seen in FIGS. 3B and 3C), as well as upper and lower sealing extensions, one of which is shown at 174.

Having described a preferred structure of the overall mullion seal assembly of the present invention, reference will now be made to FIGS. 3A-3C in describing a preferred method of operation. With initial reference to FIG. 3A, doors 28 and 29 are shown closed and sealed. In this configuration, first and second sealing pads 134 and 160 are in contact over a substantial surface area. In this preferred embodiment, the contact area is established by interengaging arcuate surfaces. That is, as shown labeled in FIG. 3B, first sealing pad 134 establishes a concave sealing surface 177, while second sealing pad 160 defines a complementary, convex sealing surface 180. With the linear biasing of second mullion member 128 and the angular biasing of mounting arm 163, first and second sealing pads 134 and 160 are closely registered to establish an effective seal in the central region of doors 28 and 29. In addition, upper and lower sealing extensions 174 abut sealing blocks 139 and 140, with each of these structures being formed from an elastomeric material and which can also be structured to have a magnetic attraction there between, to complete the overall seal in combination with gaskets 71. At the same time, upper and lower alignment extensions 172 ride on respective ledges 136 to assure proper relative vertical positioning of doors 28 and 29.

Figure 3B:
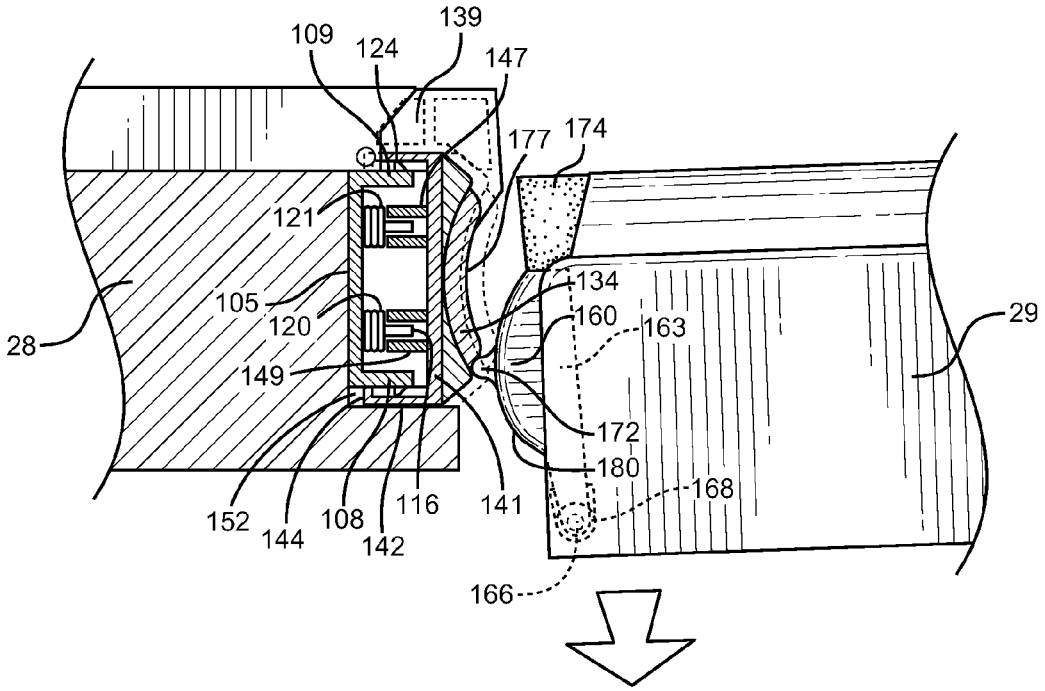
FIG. 3B is a partial cross-sectional view of the French-style doors of FIG. 1 showing one of the doors being opened so as to assume a partially sealed position.
Figure 3C:
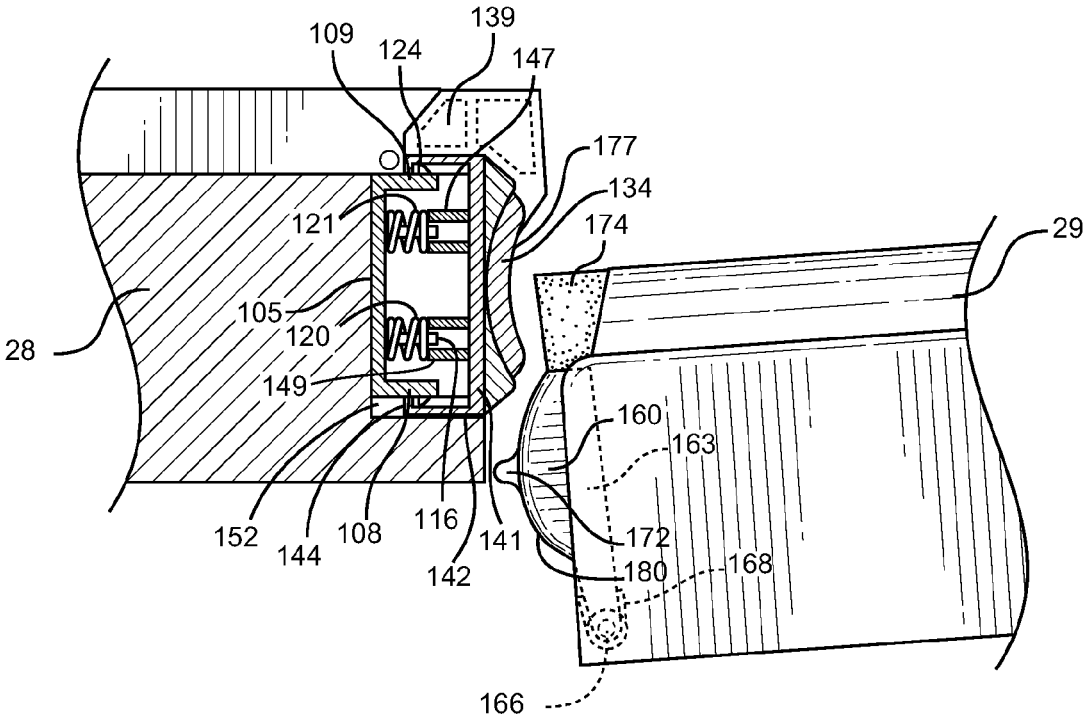
FIG. 3C is a partial cross-sectional view of the French-style doors of FIG. 1 showing the doors in an unsealed position.

Although doors 28 and 29 can be separately or simultaneously opened, FIG. 3B illustrates door 29 being opened in the direction of arrow A. As convex surface 180 rides along concave surface 177 and alignment extensions 172 ride along ledges 136, forces are generated which tend to retract each of the first and second sealing pads 134 and 160 until second seal subassembly 92 clears first seal subassembly 90 as shown in FIG. 3C. During closing of the door(s) 28, 29, a similar deflection and biased extension operation occurs to establish the tight sealing condition of FIG. 3A.

Although described with reference to a preferred embodiment of the present invention, it should be readily apparent of one of ordinary skill in the art that various changes and/or modifications can be made to the invention without departing from the spirit thereof. For instance, the individual seal subassemblies could be mounted on either one of the French-style doors. In addition, while preferred biasing structure has been described, it should be apparent that other biasing arrangements could be employed. Furthermore, the mounting of the guiding elements and sleeves could be reversed without affecting their functions. Overall, it should be recognized that the preferred shapes of the sealing pads provide a quite large cross-section for the overall sealing area and establish a high insulation value. In fact, based on the enhanced sealing and high insulation value, the spring loaded mullion arrangement of the invention advantageously eliminates the need for an internal heater commonly employed in refrigerator doors. In general, the invention is only intended to be limited to the scope of the following claims.

What is claimed is:

1. A refrigerator comprising:

a cabinet shell including a first compartment and a second compartment, each of said first and second compartments including a respective opening for receiving items to be refrigerated;

first and second French-style doors pivotally mounted to the cabinet shell about the opening of the first compartment at laterally spaced locations, each of said first and second doors including an inner side wall portion, wherein the inner side wall portions of the first and second doors define a space between the doors when the doors are in a closed configuration;

first and second gaskets arranged between the first and second doors and the cabinet shell for sealing perimeter portions of the opening of the first compartment; and a mullion seal assembly including:

a first seal subassembly provided on the inner side wall portion of the first door, said first seal subassembly including a first sealing pad extending along and biased for linear movement away from the inner side wall portion of the first door; and a second seal subassembly provided on the inner side wall portion of the second door, said second seal subassembly including a second sealing pad extending along and being biased for angular movement away from the inner side wall portion of the second door wherein, upon closing the first and second doors, the first and second sealing pads are biased into engagement to create a seal along the inner side wall portions of the first and second doors.

2. The refrigerator according to claim 1, wherein the first seal subassembly further includes a plurality of spring elements acting between the first door and the first sealing pad to linearly bias the first sealing pad.

3. The refrigerator according to claim 2, wherein the first seal subassembly further includes a base mounted in a recess formed in the inner side wall portion of the first door, said plurality of spring elements acting between the base and the first sealing pad.

4. The refrigerator according to claim 3, wherein the first seal subassembly further includes a plurality of guide elements extending from the base, said plurality of spring elements being arranged about the plurality of guide elements.

5. The refrigerator according to claim 4, further including a plurality of sleeves extending from the first sealing pad, said plurality of guide elements extending into the plurality of sleeves for guiding the first sealing pad for linear movement.

6. The refrigerator according to claim 5, wherein the plurality of spring elements abut the plurality of sleeves and linearly bias the first sealing pad away from the base.

7. The refrigerator according to claim 4, further comprising a plurality of catch elements provided on the base, said plurality of catch elements limiting relative movement between the base and the first sealing pad.

8. The refrigerator according to claim 1, wherein the second seal subassembly further includes at least one spring acting between the second door and the second sealing pad to bias the second sealing pad for pivotal movement relative to the second door.

9. The refrigerator according to claim 8, wherein the second seal subassembly further includes a mounting arm pivotally mounted to the second door, said second sealing pad being fixed to the mounting arm.

10. The refrigerator according to claim 9, wherein the at least one spring constitutes a torsion spring acting between the second door and the second sealing pad.

11. The refrigerator according to claim 1, wherein the first and second sealing pads include complementary concave and convex sealing surfaces.

12. The refrigerator according to claim 1, further comprising an alignment extension extending from one of the first and second sealing pads, wherein another one of the first and second sealing pads includes a ledge, said alignment extension sliding along the ledge upon closing of the first and second doors.

13. The refrigerator according to claim 1, wherein the mullion seal assembly lacks an internal heater.

14. A method of sealing an opening providing access to a refrigerator compartment upon closing either one or both of first and second laterally spaced French-style doors comprising:

biasing a first sealing pad, which extends along an inner side wall portion of the first door, linearly away from the inner side wall portion; and biasing a second sealing pad, which extends along an inner side wall portion of the second door, angularly away from the inner side wall portion of the second door wherein the inner side wall portions of the first and second doors define a space between the doors when the doors are in a closed configuration and, to seal the opening, the first and second sealing pads are biased into engagement to create a seal with the space along the inner side wall portions of the first and second doors.

15. The method of claim 14, wherein biasing the first sealing pad is performed through a plurality of spring elements acting between the first door and the first sealing pad to linearly bias the first sealing pad.

16. The method of claim 15, further comprising: biasing the first sealing pad away from a base mounted in a recess formed in the inner side wall portion of the first door.

17. The method of claim 16, further comprising: guiding the first sealing pad for linear movement through a plurality of guide elements extending from one of the base and the first sealing pad, and into a plurality of sleeves extending from another of the base and the first sealing pad, said plurality of spring elements being arranged about the plurality of guide elements.

18. The method of claim 14, further comprising: limiting linear movement of the first sealing pad by engaging a plurality of catch elements.

19. The method of claim 14, wherein biasing the second sealing pad is performed through at least one spring acting between the second door and the second sealing pad to bias the second sealing pad for angular movement relative to the second door.

20. The method of claim 19, wherein biasing the second sealing pad is further performed through a mounting arm pivotally mounted to the second door, said second sealing pad being fixed to the mounting arm.

21. The method of claim 20, wherein the at least one spring constitutes a torsion spring acting between the second door and the second sealing pad.

22. The method of claim 14, further comprising: sealing the first and second sealing pads through complementary concave and convex sealing surfaces.

23. The method of claim 14, further comprising: aligning an extension extending from one of the first and second sealing pads with structure on another one of the first and second sealing pads upon closing of the first and second doors.

* * * * *